US007798157B2

(12) United States Patent
Kim

(10) Patent No.: US 7,798,157 B2
(45) Date of Patent: Sep. 21, 2010

(54) CONDENSING APPARATUS OF DISH WASHER

(75) Inventor: Yong Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 312 days.

(21) Appl. No.: 10/580,115

(22) PCT Filed: Oct. 6, 2005

(86) PCT No.: PCT/KR2005/003318

§ 371 (c)(1),
(2), (4) Date: May 19, 2006

(87) PCT Pub. No.: WO2006/080707

PCT Pub. Date: Aug. 3, 2006

(65) Prior Publication Data

US 2009/0038654 A1 Feb. 12, 2009

(30) Foreign Application Priority Data

Oct. 12, 2004 (KR) ..... 10-2004-0081272

(51) Int. Cl.
*B08B 3/00* (2006.01)

(52) U.S. Cl. ..... 134/107; 134/108

(58) Field of Classification Search ..... None
See application file for complete search history.

(56) References Cited

U.S. PATENT DOCUMENTS

| | | | | | |
|---|---|---|---|---|---|
| 3,068,877 | A | * | 12/1962 | Jacobs | 134/99.1 |
| 4,247,158 | A | * | 1/1981 | Quayle | 312/213 |
| 5,076,306 | A | * | 12/1991 | Suzuki et al. | 134/95.2 |
| 5,277,210 | A | * | 1/1994 | Kim | 134/95.2 |
| 5,337,500 | A | | 8/1994 | Enokizono | |
| 5,660,195 | A | * | 8/1997 | Taylor et al. | 134/58 D |
| 2003/0140517 | A1 | * | 7/2003 | Schmid | 34/78 |

FOREIGN PATENT DOCUMENTS

| | | | |
|---|---|---|---|
| DE | 3538305 | A1 | 4/1987 |
| DE | 1994-6456 | A1 | 4/2001 |

* cited by examiner

*Primary Examiner*—Michael Barr
*Assistant Examiner*—Jason Y Ko
(74) *Attorney, Agent, or Firm*—McKenna Long & Aldridge LLP

(57) ABSTRACT

A condensing apparatus of a dish washer is provided. The condensing apparatus includes a blower and an air duct. The blower suctions vapor from inside a tub of the dish washer. The air duct is connected to the blower, and has a vapor passage formed therein through which the vapor flows and in which condensed water is formed. The vapor passage has a ridge formed thereon to stop the condensed water.

9 Claims, 5 Drawing Sheets

【Figure 1】
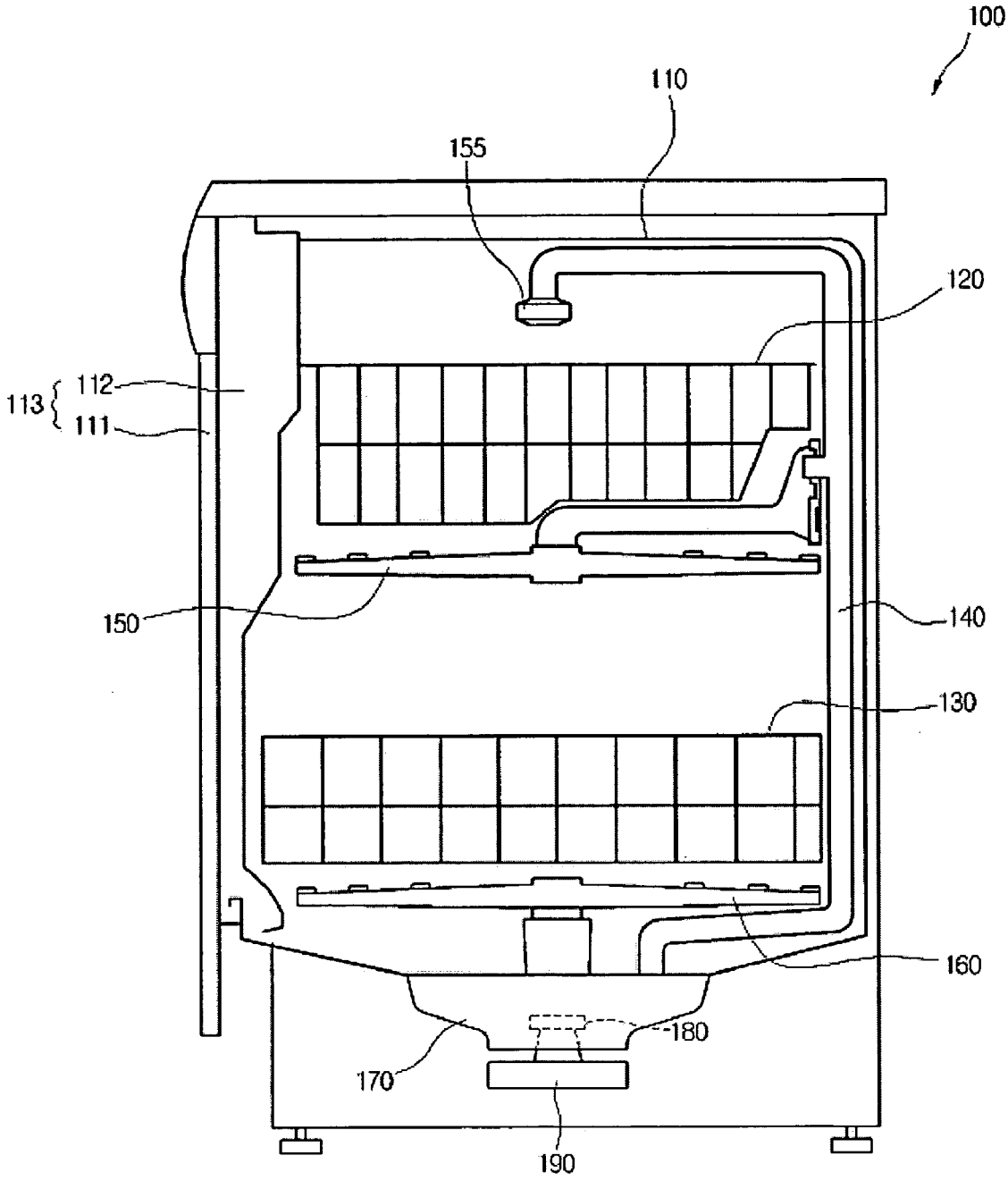

【Figure 2】
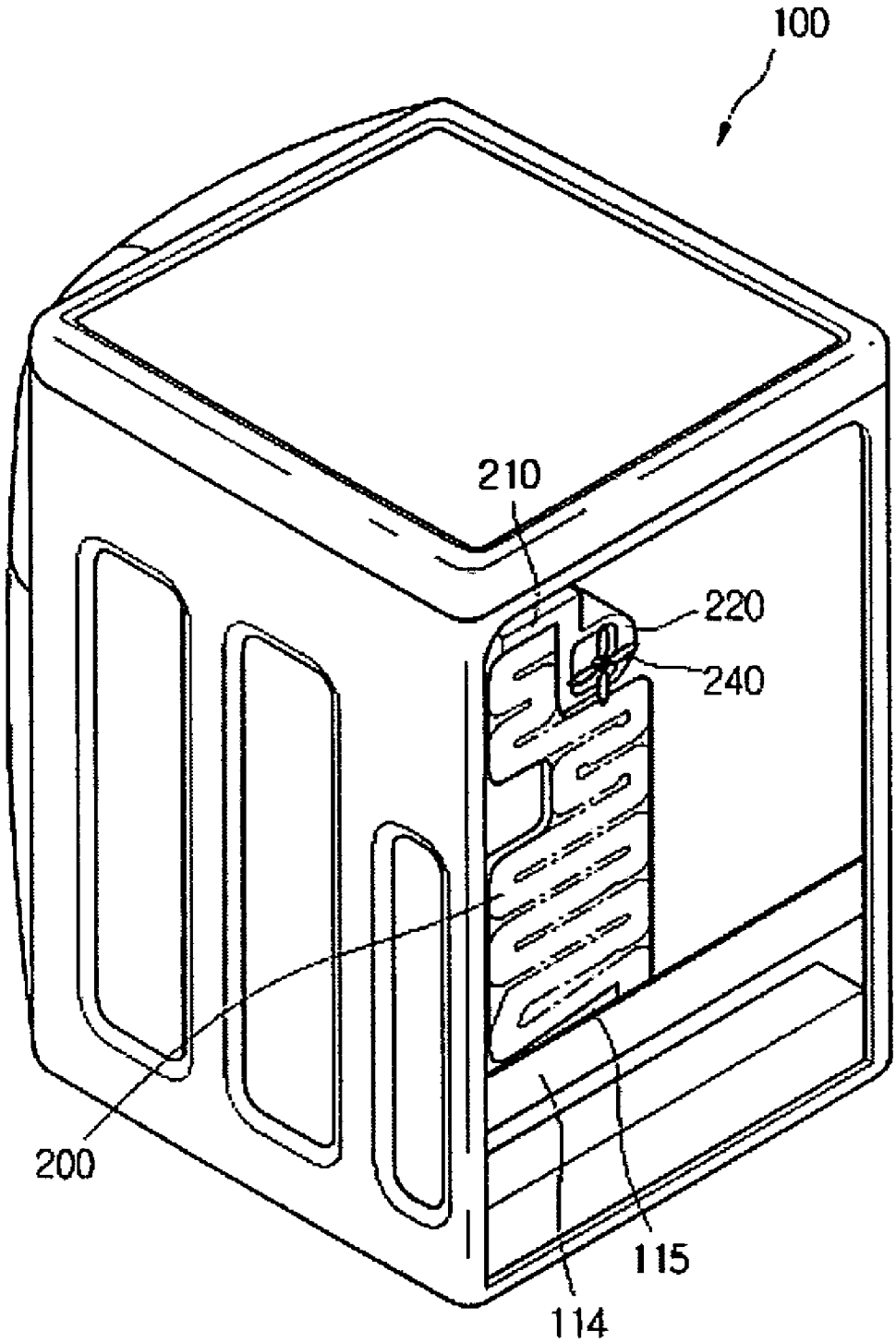

【Figure 3】
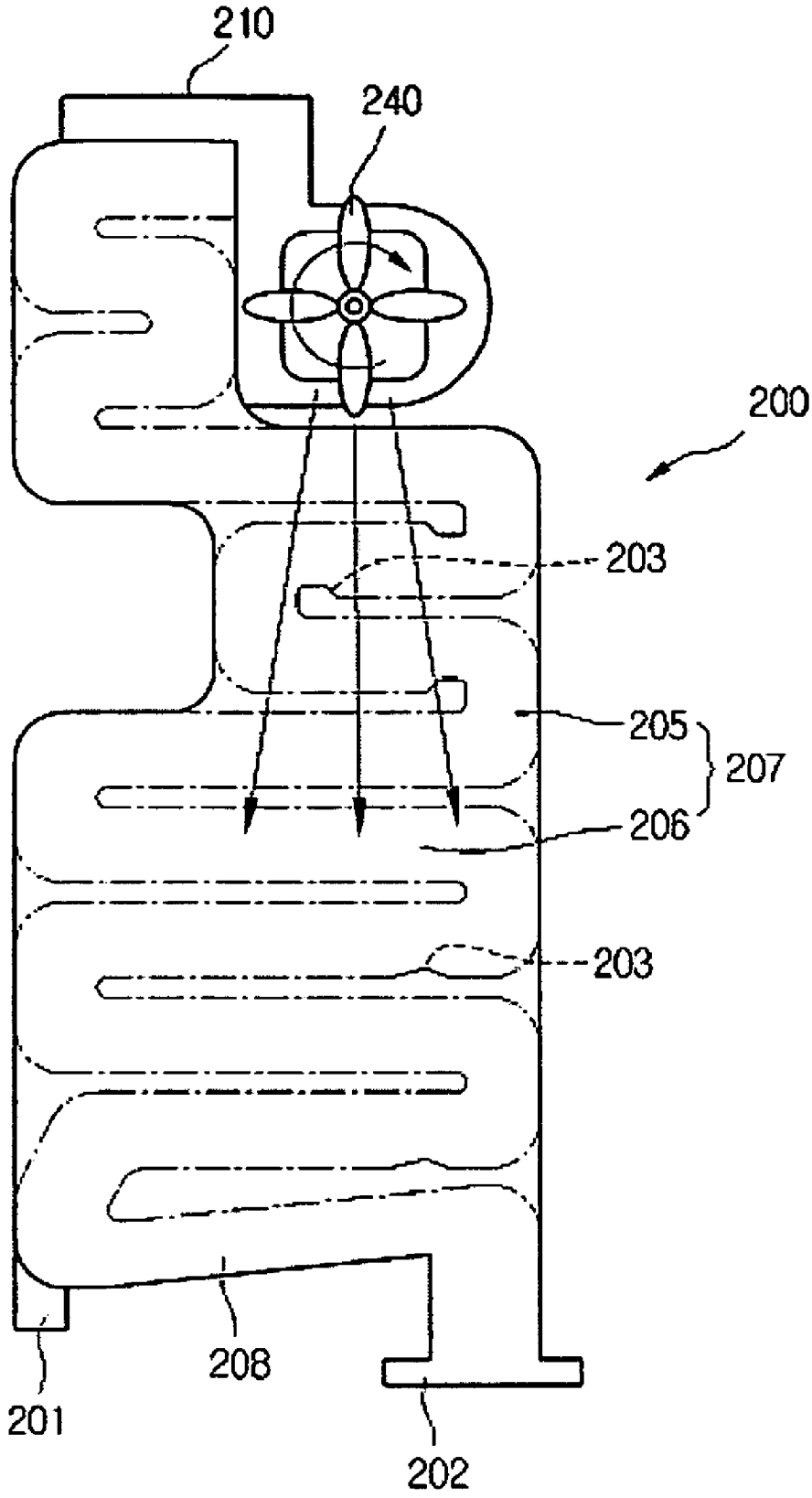

【Figure 4】
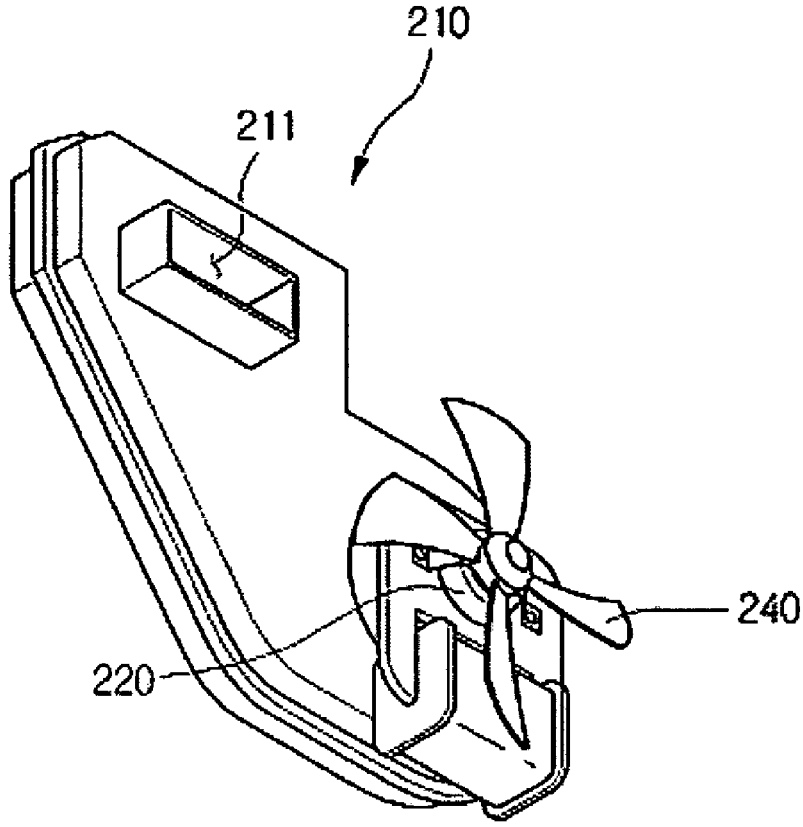
【Figure 5】
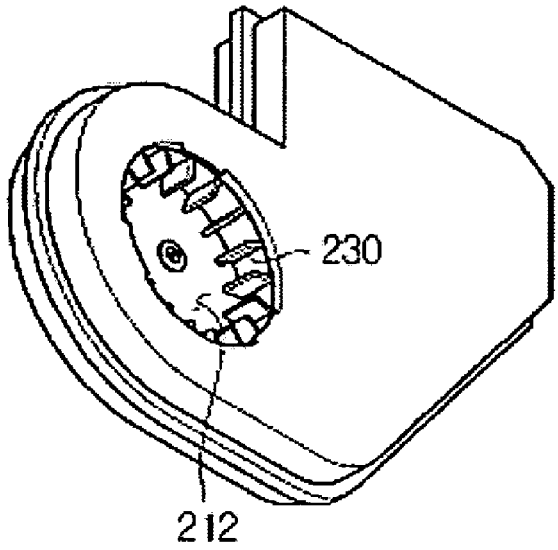

【Figure 6】
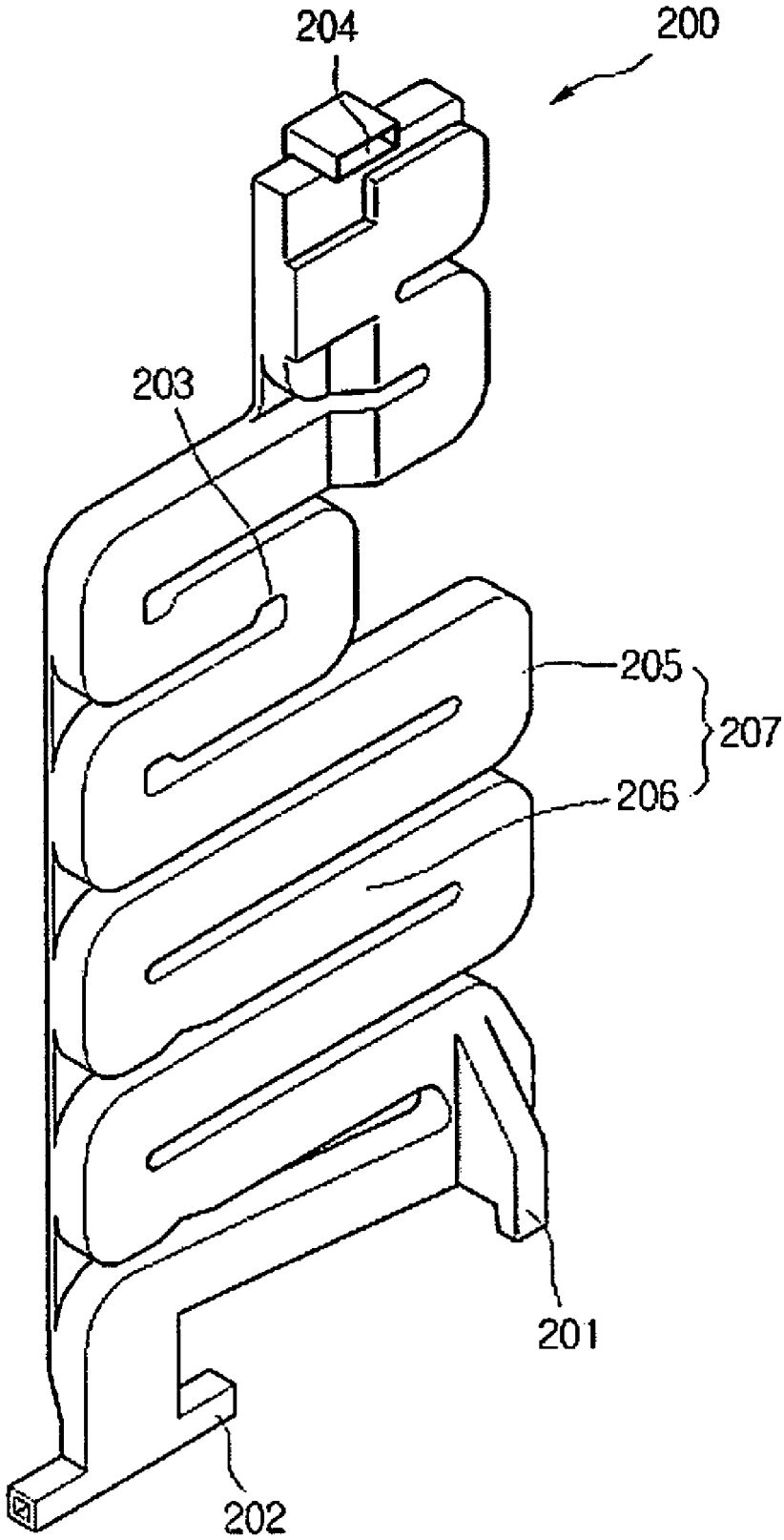

CONDENSING APPARATUS OF DISH WASHER

This application claims priority to International Application No. PCT/KR2005/003318 filed on Oct. 6, 2005, as well as Korean Application 10-2004-81272 filed on Oct. 12, 2004, both of which are incorporated by reference, as if fully set forth herein.

TECHNICAL FIELD

The present invention relates to a dish washer, and more particularly, to a condensing apparatus of a dish washer capable of condensing steam that is created during a drying cycle.

BACKGROUND ART

A dish washer is a home appliance that uses a wash pump to circulate wash liquid to be sprayed from spray nozzles to wash dishes placed in an upper and lower rack, and dries the dishes after they are washed.

Conventional dish washers have an air duct for outwardly exhausting hot, moist vapor that forms during a drying cycle. This air duct is installed on the door of the dish washer. After the drying cycle is completed, a dryer fan rotates to vent the hot, moist vapor into the air duct. The vented vapor is discharged outward from the front of the dishwasher through a steam vent formed at the front of the door.

However, such a condensing apparatus of a related art dish washer expels hot, moist vapor directly out into an interior of a room. Accordingly, it can be directly expelled towards persons near the dish washer, and can cause burns and other discomfort. Furthermore, the expelled vapor can affect wallpaper and wood inside the room, causing corrosion and deformation thereof. Moreover, the expelled hot, moist vapor can condense and collect on the floor around the dishwasher, which can cause passers-by to slip and injure themselves.

DISCLOSURE

Technical Problem

To solve these problems, the present invention provides a condensing apparatus of a dish washer that can reliably condense the moisture from the vapor created in a drying cycle, and prevent the vapor from being directly expelled outward from the dish washer.

Technical Solution

To achieve the above objects, there is provided a condensing apparatus of a dish washer including: a blower for suctioning the vapor from inside the tub; and an air duct connected to the blower and forming a vapor passage for circulating the vapor and generating condensed water; wherein the vapor passage includes a ridge formed thereon for stopping the condensed water.

According to another aspect of the present invention, there is provided a condensing apparatus of a dish washer including: a vapor passage formed in the air duct for circulating the vapor suctioned from inside the tub and generating condensed water; and a ridge formed on the vapor passage for stopping the condensed water.

According to a further aspect of the present invention, there is provided a condensing apparatus of a dish washer including: a dryer fan for providing suctioning force to suction vapor from inside the tub; an air duct forming a vapor passage for circulating the suctioned vapor and generating condensed water and a ridge formed on the vapor passage for stopping the condensed water; and a condenser fan for blowing air at the air duct to exchange heat with the vapor circulating inside the vapor passage.

ADVANTAGEOUS EFFECTS

An advantage of the condensing apparatus of a dish washer according to the present invention is that a separate condenser fan is installed to blow air towards the air duct, so that hot, moist vapor formed during a drying cycle can be vented into the air duct and quickly condensed.

Another advantage of the condensing apparatus of a dish washer according to the present invention is that vapor that has passed through the air duct and has been de-moisturized flows back into the tub of the dish washer, and is not expelled outside the dish washer. Accordingly, users near the dish washer being injured or articles such as wallpaper and wooden furniture being damaged and deformed by the vapor can be prevented.

A further advantage of the condensing apparatus of a dish washer according to the present invention is that because the dryer fan and the condenser fan are driven by a common motor, the above effects are achieved by the condenser fan while its operational efficiency increases.

A still further advantage of the condensing apparatus of a dish washer according to the present invention is that due to a ridge formed in the vapor passage inside the duct, condensed water is caught by the ridge. Therefore, the condensed water vapor is reliably condensed, and processing of the condensed water becomes easier.

DESCRIPTION OF DRAWINGS

The spirit of the present invention can be understood more fully with reference to the accompanying drawings. In the drawings:

FIG. 1 is a sectional view of a dishwasher having a condensing apparatus according to the present invention;

FIG. 2 is a perspective view showing the front of a dishwasher having a condensing apparatus according to the present invention;

FIG. 3 is a frontal view of a condensing apparatus according to the present invention;

FIG. 4 is a frontal perspective view of a blower for a condensing apparatus according to the present invention;

FIG. 5 is a rear perspective view of the blower in FIG. 4; and

FIG. 6 is a rear perspective view of an air duct for a condensing apparatus according to the present invention.

BEST MODE

Hereinafter, preferred embodiments of a condensing apparatus of a dish washer according to the present invention will be described in detail with reference to the accompanying drawings.

FIG. 1 is a sectional view of a dishwasher having a condensing apparatus according to the present invention.

Referring to FIG. 1, a dish washer 100 according to the present invention includes a tub 110 forming the outer shape of the dish washer 100 and a wash compartment within, a door 113 formed at the front of the tub 110 for opening and closing the wash compartment, and a sump 170 formed at a lower central portion of the tub 110 for holding wash liquid.

In further detail, the door 113 has a front panel 111 forming the exterior thereof and a liner 112 installed behind the front panel 111. An air duct according to the present invention (to be henceforth described) is installed between the front panel 111 and the liner 112.

Also, a wash pump 180 for pumping wash liquid stored in the sump 170 under high pressure is formed inside the sump 170, and a wash motor 190 is mounted below the wash pump 180 for driving the wash pump 180.

The dish washer 100 further includes a water guide 140 providing a route for wash water pumped by the wash pump 180, a lower spray arm 160 provided above the sump 170 and formed at the bottom of the wash compartment to spray wash water upward, an upper spray arm 150 extending vertically from the upper portion of the water guide 140 and located in the central portion inside the wash compartment, and a top spray nozzle 155 formed at the ceiling of the tub for spraying wash liquid in a vertically downward direction.

Also included are an upper rack 120 installed above the upper spray arm 150 for holding dishes to be washed by the upper spray arm 150, and a lower rack 130 installed above the lower spray arm 160 for holding dishes to be washed by the lower spray arm 160.

In more detail, the upper rack 120 is supported by rails (not shown) on the inner walls of the tub 110 to be capable of moving forward and backward.

An explanation on the operation of the dish washer 100 according to the present invention will now be given.

First, a user opens the door 111 of the dishwasher, and pulls out the upper rack 120 and/or the lower rack 130. Then, dishes are placed on the racks 120 and 130. Next, the user closes the door 111, turns the power on, and activates the dish washer.

When the start button is pressed on the dishwasher 100 and the wash cycle begins, wash liquid from a water supply enters the sump 170. After the entry of a predetermined amount of wash liquid into the sump 170 is completed, the wash motor 190 is activated. An impeller (not shown) attached to the wash motor 190 shaft and installed in the wash pump 180 rotates, pumping the wash liquid to the lower nozzle 160 and the water guide 140.

The wash liquid pumped to the water guide 140 moves to the top spray nozzle 155 and the upper spray arm 150 to be sprayed therefrom into the wash compartment. The dishes stacked on the racks 120 and 130 are cleaned by the sprayed wash liquid.

Here, the top spray nozzle 155 sprays wash liquid vertically downward, and the upper spray arm 150 sprays wash liquid vertically upward to wash the dishes stacked on the upper rack 120.

Additionally, the lower spray arm 160 sprays wash liquid vertically upward to wash the dishes stacked on the lower rack 130. Also, spray holes may be formed on the bottom of the upper spray arm 150 to spray wash liquid downward to simultaneously wash the upper portions of dishes stacked on the lower rack 130.

After the wash cycle is completed, contaminants in the dirty wash water collected in the sump 170 are removed by a filter (not shown). The wash water from which the contaminants are removed is then discharged from the dishwasher 100 via a drain pump (not shown).

When wash liquid is discharged to the outside, clean wash liquid is routed into the sump 170 via an entrance hole and is discharged through the nozzles 150 and 160 in the same manner as in the wash cycle. The clean wash liquid that is discharged rinses the dishes in the racks.

When the rinse cycle is complete, a drying cycle is implemented, to complete the entire wash cycle. Here, in the drying cycle, hot air that enters the tub 110 absorbs moisture from the dishes. Thus, the hot, dry air in the tub 110 becomes hot, moist air. The hot, moist air passes through an air duct (not shown) installed at the front of the liner 112 on the door 113, and is discharged from the tub 110 to the outside. The discharging of moist vapor through the air duct will now be described with reference to the drawings.

FIG. 2 is a perspective view showing the front of a dishwasher having a condensing apparatus according to the present invention.

Referring to FIG. 2, the air duct 200 according to the present invention is installed at the front of the liner 112, and is protected by the front panel 111.

In further detail, a blower 210 is installed at one end of the upper portion of the liner 112 to allow the moist vapor to be discharged into the air duct 200 from inside the tub 110. The blower 210 is connected to the air duct 200. Therefore, the moist vapor that is suctioned by the blower 210 flows along the air duct 200. Also, installed at the front of the blower 210 is a condenser fan 240 for blowing cold air to lower the temperature of the moist vapor flowing through the inside of the air duct 200. The condenser fan 240 evenly circulates the cold air, which is supplied at the top of the air duct 200 to flow towards the bottom thereof. Therefore, the blower 210 may be disposed at the top of the air duct 200.

A moist air absorber 115 is installed at the lower portion of the air duct 200 to absorb the cool air discharged from the air duct 200. The moist air absorber 115 is supported by a bracket 114 at the front of the liner 112 connecting either side thereof. The moist air absorber 115 used may be made of a porous material such as a sponge.

The moist air leaving the tub 110 during the drying cycle in the above embodiment flows through the blower 210 and the air duct 200. The air that is condensed while exiting the bottom of the air duct 200 passes through the moist air absorber 115 to be re-filtered. In other words, the condensed air that leaves the air duct 200 is diffused as it passes through the moist air absorber 115, and is expelled from the bottom of the dish washer 100. Accordingly, a user is not directly subjected to the air expelled from the air duct 200.

FIG. 3 is a frontal view of a condensing apparatus according to the present invention.

Referring to FIG. 3, the condensing apparatus of a dish washer according to the present invention includes: a blower 210 installed at the front of the liner 112 for suctioning air from inside the tub 110, and an air duct 200 that is coupled to the front of the blower 210 at a top portion of the air duct 200. Installed within the blower 210 is a fan (to be described later) for suctioning air from inside the tub 110. A condenser fan 240 for blowing cold air to lower the temperature of the air duct 200 is integrally coupled with the fan and is installed at the front of the blower 210.

Specifically, the air duct 200, as illustrated, is bent a plurality of times to form a meander line in order to lengthen the passage for air flowing through the air duct 200. Disposed at a lower portion of the air duct 200 are a condensed water discharge port 201 for discharging condensed water from the air cooled while flowing through the air duct 200, and a vapor exhaust port 202 for exhausting the air that flows through the air duct 200.

The vapor exhaust port 202 formed at the end of the air duct 200 is formed vertically. The straight portion 208 connecting the curved portion (where the condensed water discharge port 201 is formed) and the curved portion (where the vapor exhaust port 202 begins) is inclined at a predetermined angle. Specifically, the curved portion at the point where the condensed water discharge port 201 is formed is disposed below the curved portion where the vapor exhaust port 202 begins. Accordingly, the condensed water flowing along the inside of the air duct is ultimately discharged at the condensed water discharge port 201 into the tub. By dividing the end of the vapor exhaust port 202 into an opposing dual port, the vapor exhausted from the air duct 200 passes through the moist air absorber 115.

In the above structure, the hot, moist air inside the tub 110 is suctioned by the blower 210 into the air duct 200. The hot, moist air flows along the air duct 200, and exchanges heat with the cold air fed by the rotating condenser fan 240. The cold air may be fed by the condenser fan 240 to flow along the outside of the air duct 200. The water vapor is condensed through the heat exchange, and the condensed water re-enters the tub 110 through the condensed water discharge port 201. The air is then exhausted through the vapor exhaust port 202 to the outside.

FIG. 4 is a frontal perspective view of a blower for a condensing apparatus according to the present invention, FIG. 5 is a rear perspective view of the blower in FIG. 4, and FIG. 6 is a rear perspective view of an air duct for a condensing apparatus according to the present invention.

Referring to FIGS. 4 through 6, the air duct 200 according to the present invention includes a water vapor intake port 204 at the top of the air duct 200 for intaking water vapor provided by the blower 210, and a vapor passage 207 that the water vapor that enters the water vapor intake port 204 flows through.

In detail, the vapor passage 207, as explained above, is formed with alternating curved and straight portions 205 and 206, creating a meander line. Therefore, the water vapor spends a longer period of time within the vapor passage 207. As the water vapor flows along the vapor passage 207, it encounters resistance that makes it contact the inner surface of the air duct 200, thereby increasing heat exchange effectiveness.

Additionally, the vapor passage 207 has a ridge 203 formed to protrude a predetermined height from its floor. The ridge 203 protrudes a predetermined height from the floor at a point where the straight portion 206 ends and the curved portion 205 begins, or protrudes a predetermined height from the floor at a predetermined point along the straight portion 206. By forming the ridge 203, the condensed water (formed during the passage of water vapor through the inside of the air duct 200) collects on the floor of the air duct 200.

The blower 210 that blows water vapor into the air duct 200 has a dryer fan 230 installed within and a drive motor 220 installed at the front for driving the dryer fan 230. Installed at the front of the drive motor 220 is a condenser fan 240 for blowing cold air for cooling the water vapor flowing through the inside of the air duct 200. The drive shaft of the dryer fan 230 is connected to the condenser fan 240, so that the dryer fan 230 and the condenser fan 240 rotate together. Because a single drive motor 220 rotates the dryer fan 230 and the condenser fan 240 together, a separate motor for driving the condenser fan 240 is not required. The condenser fan 240 increases heat-exchanging effectiveness by evenly condensing the vapor circulating inside the air duct 200. Because a separate motor for driving the condenser fan 240 is not needed, the structure of the blower is simplified and compacted. The dryer fan 230 and the condenser fan 240 may be cross-flow fans that suction air towards the shaft and discharge air in a radial direction.

Formed at the front of the blower 210 is a water vapor exhaust port 211 connected to the water vapor intake port 204 of the air duct 200, and a water vapor suction port 212 for suctioning water vapor from inside the tub 110 is formed at the rear of the blower 210.

During a drying cycle, the dryer fan 230 and the condenser fan 240 operate, and the water vapor inside the tub 110 is suctioned through the water vapor suction port 212 into the blower 210. Then, the water vapor is discharged through the water vapor exhaust port 211 and flows into the air duct 200. The water vapor that flows into the air duct 200 exchanges heat with cold air provided by the rotating condenser fan 240.

As described above, the vapor passage of the air duct 200 is formed in a meandering line, and the condenser fan 240 is installed at the front of the blower 210, so that hot, moist air from inside the tub 110 can be cooled rapidly. The condensing apparatus of a dish washer according to the present invention has a separately installed condenser fan that blows air towards the air duct, so that hot, moist air generated during a drying cycle is able to quickly condense while flowing through the air duct.

Also, in the condensing apparatus of a dish washer according to the present invention, vapor that has passed through the air duct and has been de-moisturized flows back into the tub of the dish washer, and is not expelled outside the dish washer. Accordingly, users near the dish washer being injured or articles such as wallpaper and wooden furniture being damaged and deformed by the vapor can be prevented.

In addition, the condensing apparatus of a dish washer according to the present invention has the dryer fan and the condenser fan driven by a common motor, so that the above effects are achieved by the condenser fancondenser fanrational efficiency increases.

Furthermore, the condensing apparatus of a dish washer according to the present invention has a ridge formed in the vapor passage inside the duct, so that condensed water is caught by the ridge. Therefore, the water vapor is reliably condensed, and processing of the condensed water becomes easier.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The condensing apparatus of a dish washer according to the present invention reliably condenses steam, and can prevent vapor from affecting persons/objects outside the dishwasher. Therefore, the condensing apparatus has a wide industrial application.

The invention claimed is:

1. A condensing apparatus of a dish washer for condensing vapor inside a dish washer tub, the condensing apparatus having a top and a bottom, the condensing apparatus comprising:

a blower, at the top of the condensing apparatus, for suctioning the vapor from inside the tub;

an air duct forming a vapor passage, comprised of a plurality of vertically stacked horizontal duct segments spaced apart from each other in a vertical direction, a first end of a topmost horizontal duct segment being fluidly coupled to the blower, and each of the remaining plurality of horizontal segments being fluidly connected to the horizontal duct segment directly above it by a curved duct segment such that the air duct folds horizontally back and forth upon itself to form a vertical stack of horizontal duct segments;

a condensed water discharge port at a first side of the bottommost one of the plurality of horizontal duct segments; and a vapor exhaust port spaced apart from the condensed water discharge port at an open second end of the bottommost one of the plurality of horizontal duct segments;

wherein the air duct includes at least one ridge configured to protrude upward from an inner bottom surface of at least one of the plurality of horizontal duct segments, perpendicular to a direction of vapor being blown by the blower, and configured to collect at least some condensed vapor on the floor of the horizontal portion.

2. The condensing apparatus according to claim 1, wherein the ridge is formed at a point where the vapor passage transitions from the horizontal segment to the curved duct segment.

3. The condensing apparatus according to claim 1, wherein the bottommost one of the plurality of horizontal duct segments is inclined at a predetermined angle to dispose the condensed water discharge port lower than the vapor exhaust port, wherein the predetermined angle is larger than zero and smaller than 90 degrees to a horizontal line.

4. The condensing apparatus according to claim 1, wherein the blower includes a condenser fan for blowing air at the air duct to exchange heat with the vapor circulating inside the air duct, and a dryer fan for providing suctioning force to suction vapor from inside the tub.

5. The condensing apparatus according to claim 4, wherein the blower further includes a motor for driving the condenser fan and the dryer fan together.

6. A condensing apparatus of a dish washer having an air duct for suctioning and condensing vapor from inside a dish washer tub, the condensing apparatus comprising:

a plurality of horizontal parts forming a plurality of horizontal air duct segments;

vertical parts, extending from an upward bend at a first end of each of the plurality of horizontal air duct segments and a downward bend from a second end, opposite to the first end, wherein each upwardly bent vertical part is in fluid communication with a corresponding downwardly bent vertical part of the horizontal air duct segment immediately above it, such that the air duct folds horizontally back and forth upon itself to form a vertical stack of horizontal duct segments;

a vapor passage formed in the plurality of horizontal and vertical parts for circulating the vapor suctioned from inside the tub and generating condensed water;

a ridge within the vapor passage configured to protrude a predetermined height upward from a bottom surface of the at least one of plurality of horizontal parts for stopping and to extend across the bottom surface of the at least one of the plurality of horizontal parts in a direction in which the condensed water passing through the vapor passage is stopped by the ridge;

a condensed water discharge port formed at the air duct for discharging water condensed from the vapor into the tub; and a vapor exhaust port spaced apart from the condensed water discharge port for exhausting vapor from which water has been removed to a space outside of the-dish washer.

7. The condensing apparatus according to claim 6, wherein the ridge is formed at a point where the vapor passage transitions from the at least one of the plurality of horizontal parts to one of the vertical parts.

8. The condensing apparatus according to claim 6, wherein a lowermost air duct segment having the condensed water discharge port and the vapor exhaust port is inclined at a predetermined angle to dispose the condensed water discharge port lower than the vapor exhaust port, wherein the predetermined angle is larger than zero and smaller than 90 degrees to a horizontal line.

9. The condensing apparatus according to claim 6, further comprising a condenser fan for blowing air at the air duct to exchange heat with the vapor circulating inside the air duct, and a dryer fan for providing suctioning force to suction vapor from inside the tub.

* * * * *